US009579001B2

(12) United States Patent
Ahmed

(10) Patent No.: US 9,579,001 B2
(45) Date of Patent: Feb. 28, 2017

(54) MOBILE SPLIT-SEAT ASSEMBLY

(71) Applicant: Munir Ahmed, Spring, TX (US)

(72) Inventor: Munir Ahmed, Spring, TX (US)

(73) Assignee: MaHa Medical Equipment, Spring, TX (US)

( * ) Notice: Subject to any disclaimer, the term of this patent is extended or adjusted under 35 U.S.C. 154(b) by 600 days.

(21) Appl. No.: 13/944,461

(22) Filed: Jul. 17, 2013

(65) Prior Publication Data

US 2014/0208493 A1 Jul. 31, 2014

Related U.S. Application Data

(60) Provisional application No. 61/849,563, filed on Jan. 29, 2013.

(51) Int. Cl.

| | |
|---|---|
| ***A47K 13/00*** | (2006.01) |
| ***A47K 11/04*** | (2006.01) |
| ***A61G 7/053*** | (2006.01) |
| ***A61G 7/10*** | (2006.01) |
| *A61G 5/10* | (2006.01) |

(52) U.S. Cl.

CPC ..... *A47K 11/04* (2013.01); *A61G 7/053* (2013.01); *A61G 7/1007* (2013.01); *A61G 7/1046* (2013.01); *A61G 7/1059* (2013.01); *A61G 5/1002* (2013.01); *A61G 7/1019* (2013.01); *A61G 7/1094* (2013.01); *A61G 7/1098* (2013.01)

(58) Field of Classification Search

CPC ..... A47K 13/00

USPC ..... 4/237, 480, 483, 254

See application file for complete search history.

(56) References Cited

U.S. PATENT DOCUMENTS

| | | | | |
|---|---|---|---|---|
| 2,854,673 | A | 10/1958 | De Witt | |
| 4,052,087 | A * | 10/1977 | Gagliardi | A47K 11/04 280/43 |
| 5,148,559 | A * | 9/1992 | Morris | A61G 5/00 297/344.21 |
| 5,405,187 | A * | 4/1995 | Soderlund | A61G 7/053 297/312 |
| 8,156,581 | B2 | 4/2012 | Fogleman | |
| 2008/0078015 | A1 * | 4/2008 | Jarosinski | A47K 11/04 4/480 |
| 2013/0154231 | A1 | 6/2013 | Gabriely et al. | |

FOREIGN PATENT DOCUMENTS

| | | |
|---|---|---|
| DE | 8700016 | 3/1987 |
| JP | 2004-321630 | 11/2004 |
| JP | 2009-106692 | 5/2009 |

* cited by examiner

*Primary Examiner* — Huyen Le

(74) *Attorney, Agent, or Firm* — Nelson Mullins Riley & Scarborough, LLP

(57) ABSTRACT

A mobile split-seat assembly having a support frame including a base, a first vertical support extending upwardly from the base and a second vertical support extending upwardly from the base. A first pivoting arm assembly includes a first seat portion and is supported by the first vertical support so that the first seat portion is pivotable in a horizontal plane relative to the support frame. A second pivoting arm assembly includes a second seat portion and is supported by the second vertical support so that the second seat portion is pivotable in a horizontal plane relative to the support frame.

23 Claims, 10 Drawing Sheets

MOBILE SPLIT-SEAT ASSEMBLY

CLAIMS OF PRIORITY

This application claims priority to U.S. Provisional Application Ser. No. 61/849,563, filed Jan. 29, 2013, the entire disclosure of which is incorporated by reference herein.

FIELD OF THE INVENTION

The present invention relates generally to medical devices. More particularly, the present invention relates to a mobile split-seat assembly for allowing a caretaker to assist a person with limited physical capabilities without having to physically lift the person.

BACKGROUND OF THE INVENTION

Often, people with limited physical capabilities require assistance of some manner when moving from one place to another. For example, in minor cases, only a cane may be required, whereas in more severe cases, a wheelchair, bedside toilet, etc., or similar device may be required. A drawback of typical wheelchairs is that the person to be transported must first be fully lifted from the current support surface, such as a bed, prior to being placed in the wheelchair. As well, where the person being transported wishes to utilize bathroom facilities, such as a toilet, the person must be fully lifted from the wheelchair prior to being seated on the toilet.

The present invention recognizes and addresses considerations of prior art constructions and methods.

SUMMARY OF THE INVENTION

One embodiment of a mobile split-seat assembly in accordance with the present disclosure includes a support frame including a base and a first vertical support extending upwardly from the base, and a first pivoting arm assembly including a first seat portion, the first pivoting arm assembly being supported by the first vertical support so that the first seat portion is pivotable in a horizontal plane relative to the support frame.

Another embodiment of a mobile split-seat assembly in accordance with the present disclosure includes a mobile split-seat assembly having a support frame including a base with a pair of horizontal side rails and a front rail extending therebetween, and a pair of vertical supports extending upwardly from a front end of the base, a first pivoting arm assembly including a first seat portion, the first pivoting arm assembly being pivotably supported by a first one of the pair of vertical supports, and a second pivoting arm assembly including a second seat portion, the second pivoting arm assembly being pivotably supported by a second one of the pair of vertical support. The first seat portion and the second seat portion form a full seat when pivoted inwardly toward each other so that the first pivoting arm assembly is parallel to the second pivoting arm assembly.

A method of using a mobile split-seat assembly of the present disclosure to transport a person includes positioning the person in a seated position on a support surface, raising a first portion of the person above the support surface, positioning the first seat portion between the first portion of the person and the support surface so that the first portion of the person is supported by the first seat portion, raising a second portion of the person above the support surface, and positioning the second seat portion between the second portion of the person and the support surface so that the person is now supported by the first seat portion and the second seat portion.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
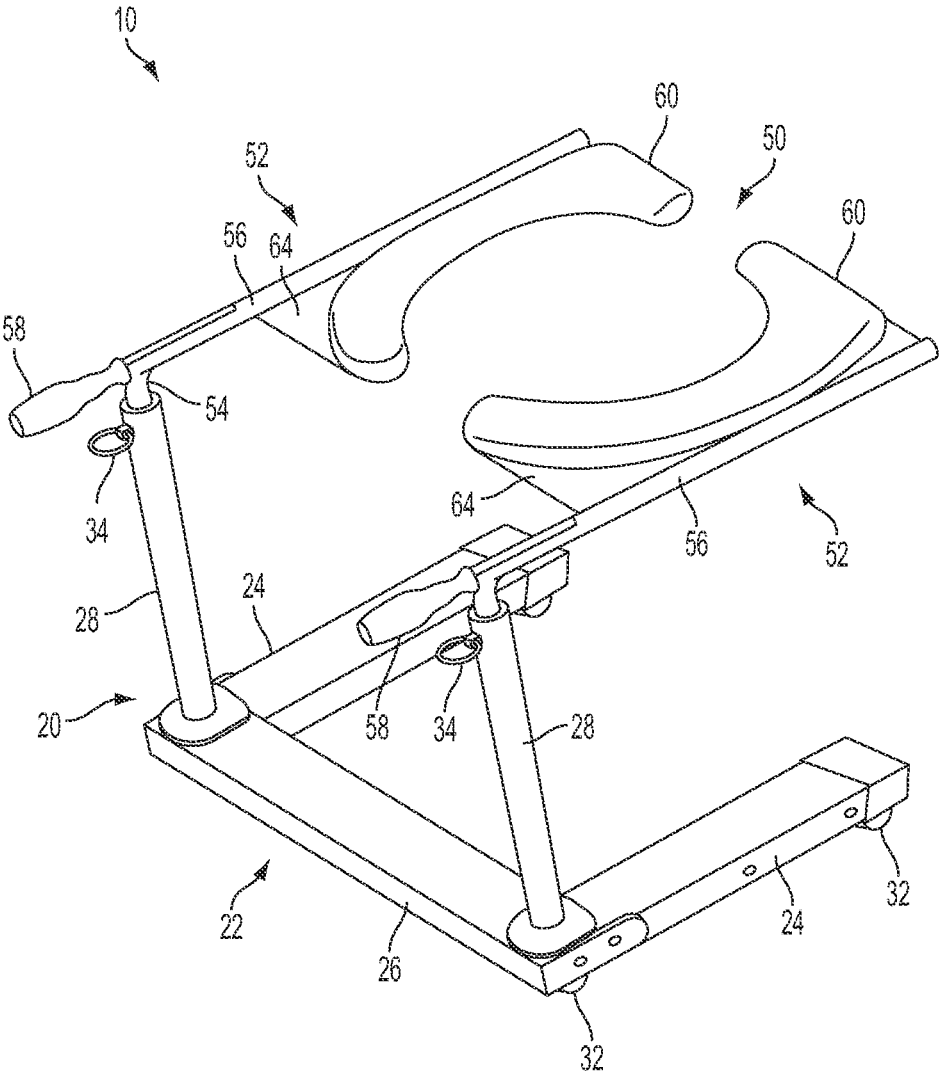
FIG. 1 is a perspective view of a mobile split-seat assembly in accordance with an embodiment of the present disclosure.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
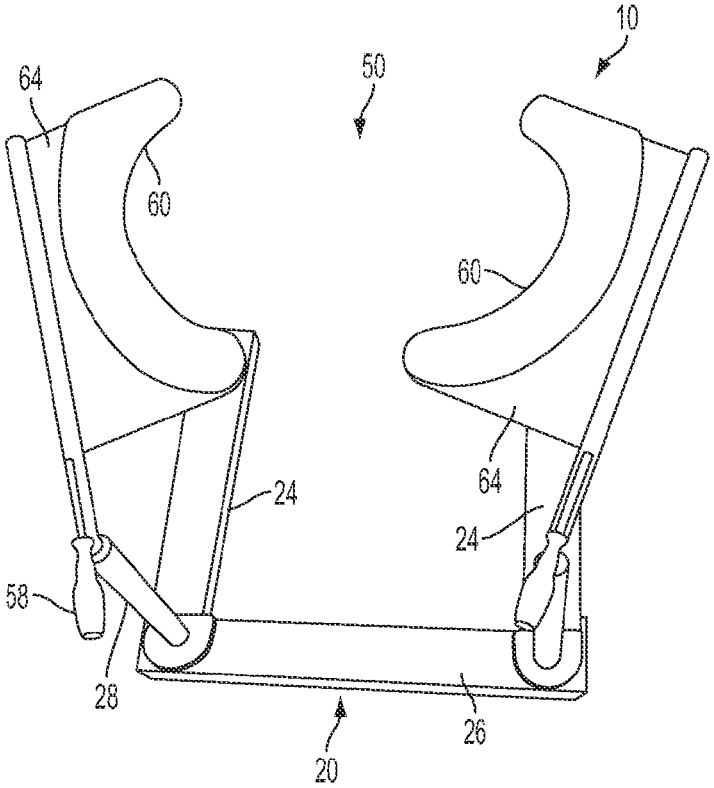
FIG. 2 is a perspective view of the mobile split-seat assembly shown in FIG. 1, with the pivoting arm assemblies in the open position.
Figure 3:
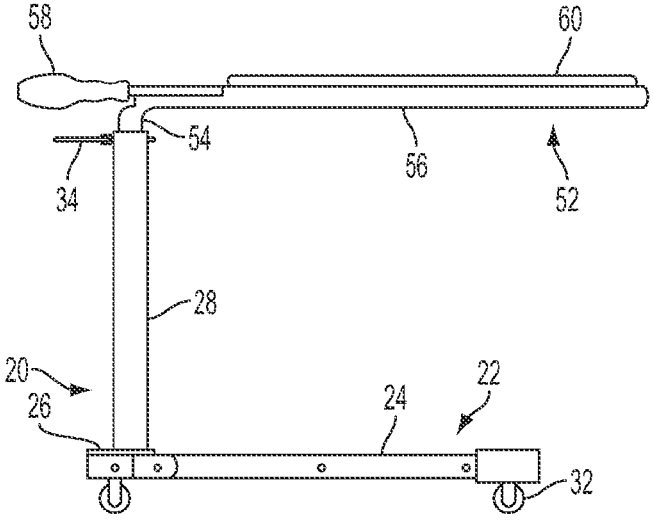
FIG. 3 is a right side view of the mobile split-seat assembly shown in FIG. 1.

Referring now to FIGS. 1 through 3, an embodiment of a mobile split-seat assembly 10 in accordance with the present disclosure includes a support frame 20 and a seat 50 formed by two pivoting arm assemblies 52. Support frame 20 includes a base 22 formed by a pair of parallel side rails 24 and a front rail 26 extending therebetween. As best seen in FIG. 1, base 22 is substantially U-shaped, with its open end at the rear of mobile split-seat assembly 10. This configuration allows mobile split-seat assembly 10 to be positioned about a toilet, as discussed in greater detail below. As well, as best seen in FIG. 3, base 22 has a low profile which facilitates sliding base 22 underneath a bed of a person to be transported, also discussed in greater detail below.

A pair of vertical supports 28 extends upwardly from opposing sides of front rail 26. As shown, each vertical support 28 is formed by a tubular post and defines a pair of pin apertures 30 (FIG. 4B) in its uppermost portion. Each pair of pin apertures 30 is configured to slidably receive a corresponding locking pin 34 for non-rotatably fixing a corresponding pivoting arm assembly 52 to the respective vertical support 28. As best seen in FIG. 3, a caster 32 is disposed at each corner of base 22 so that mobile split-seat assembly 10 is freely rollable on a support surface, such as a floor.

Pivoting arm assemblies 52 are rotatably received by vertical supports 28. Each pivoting arm assembly includes a vertical arm member 54, a horizontal arm member 56, a handle portion 58 and a seat portion 60. Vertical arm member 54 and horizontal arm member 56 may be unitarily formed from a single piece of tubing or bar stock that is bent to a 90° angle, or they can be separate members that are welded together. Preferably, each handle portion 58 extends outwardly from the corresponding vertical arm member 54 opposite horizontal arm member 56. As discussed in greater detail below, handle portions facilitate both rotation of the pivoting arm assemblies relative to support frame 20 and movement of mobile split-seat assembly 10 along a support surface.

Preferably, each vertical arm member 54 is cylindrical in shape and is rotatably received within a cylindrical bore defined by a corresponding vertical support 28. As well, each vertical arm member 54 defines a pair of pin apertures (not shown) that are configured to be selectively alignable with pin apertures 30 defined by vertical supports 28. Specifically, the pin apertures of vertical supports 28 and pivoting arm assemblies 52 are aligned when horizontal arm members 56 are parallel to each other. Each seat portion 60 is fixed to a corresponding horizontal arm member by a plate 64, and each seat portion 60 can be attached to the corresponding plate 64 by threaded fasteners, adhesives, etc. As shown in FIG. 1, seat portions 60 are positioned adjacent each other when horizontal arm members 56 are parallel, forming a full seat 50 for supporting a person. In the preferred embodiment shown, seat 50 is a toilet seat, although other types of seat configurations are possible. Mobile split-seat assembly 10 is configured such that the height of horizontal arm members 56 above a support surface, or floor, is slightly greater than the height of a support surface on which a person of the seat assembly is seated, i.e. a top surface of a mattress 42, as shown in FIG. 4A.

Figure 4A:
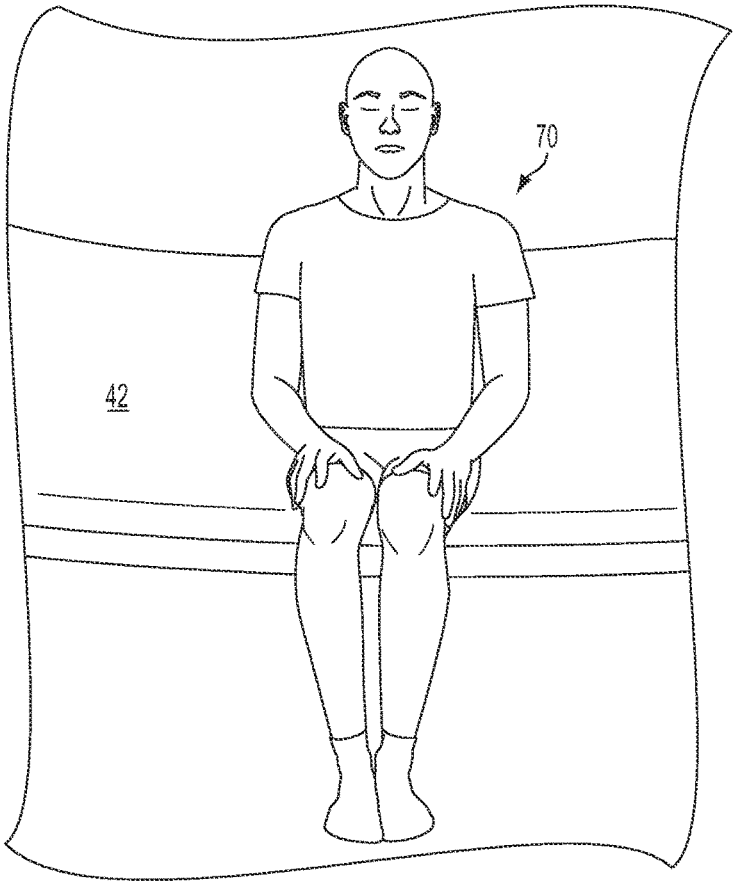
FIGS. 4A through 4F are views of the mobile split-seat assembly shown in FIG. 1 being used to facilitate moving a person of limited physical capabilities.
Figure 4B:
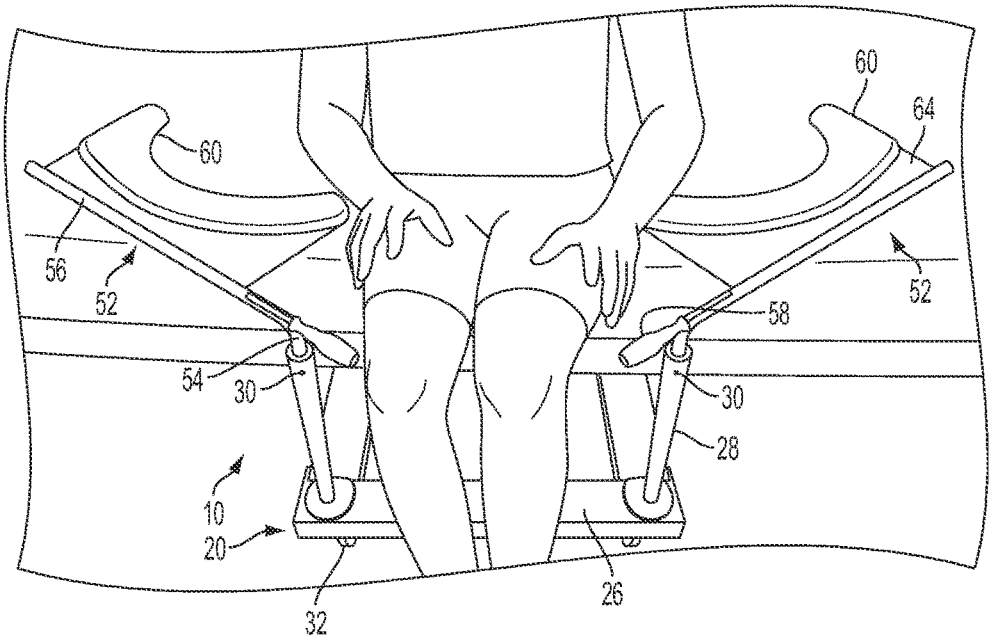

Referring now to FIGS. 4A through 4F, a method of utilizing mobile split-seat assembly 10 to assist a person having limited physical capabilities is discussed. Note, the person to be transported may perform the steps discussed below, dependent upon his level of physical ability, or may be assisted by a caretaker. As shown in FIG. 4A, the person 70 to be transported is moved to an upright seated position on a support surface 42, such as, but not limited to, a mattress 42. Next, locking pins 34 are slidably removed from vertical supports 28. As such, each pivoting arm assembly 52 is now free to rotate with respect to its corresponding vertical support 28. Rotation of handle portions 58 inwardly toward each other causes the corresponding seat portions 60 of pivoting arm assemblies 52 to move outwardly away from each other. In this configuration, as best seen in FIG. 4B, mobile split-seat assembly 10 is now configured to be rolled toward the person. As mobile split-seat assembly 10 is moved toward the person to be transported, the person is received between seat portions 60 as base 22 of support frame 20 is rolled under the bed on which the person is sitting.

Figure 4C:
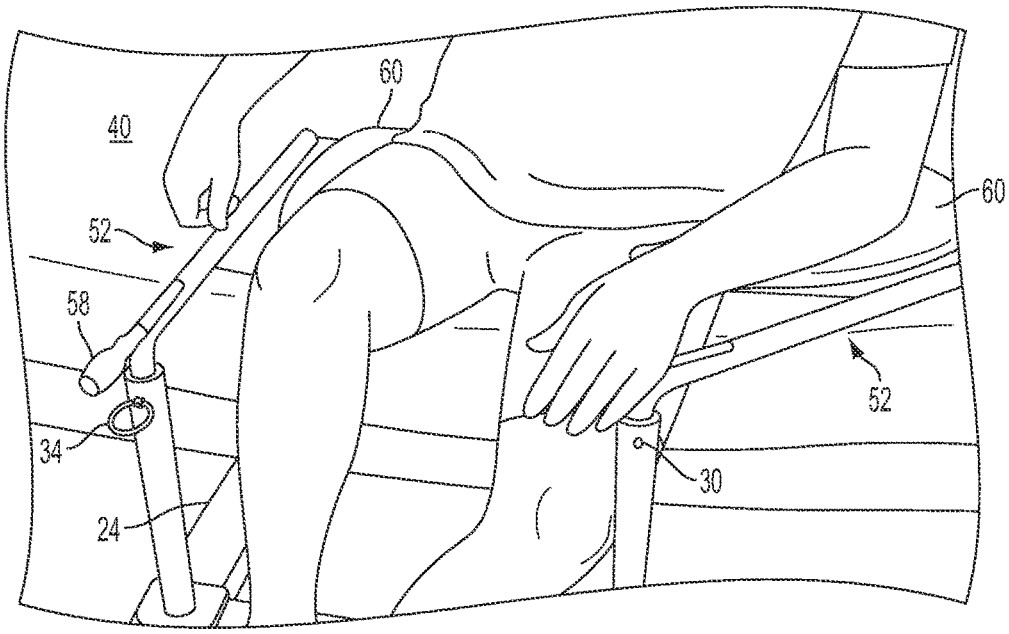
Figure 4D:
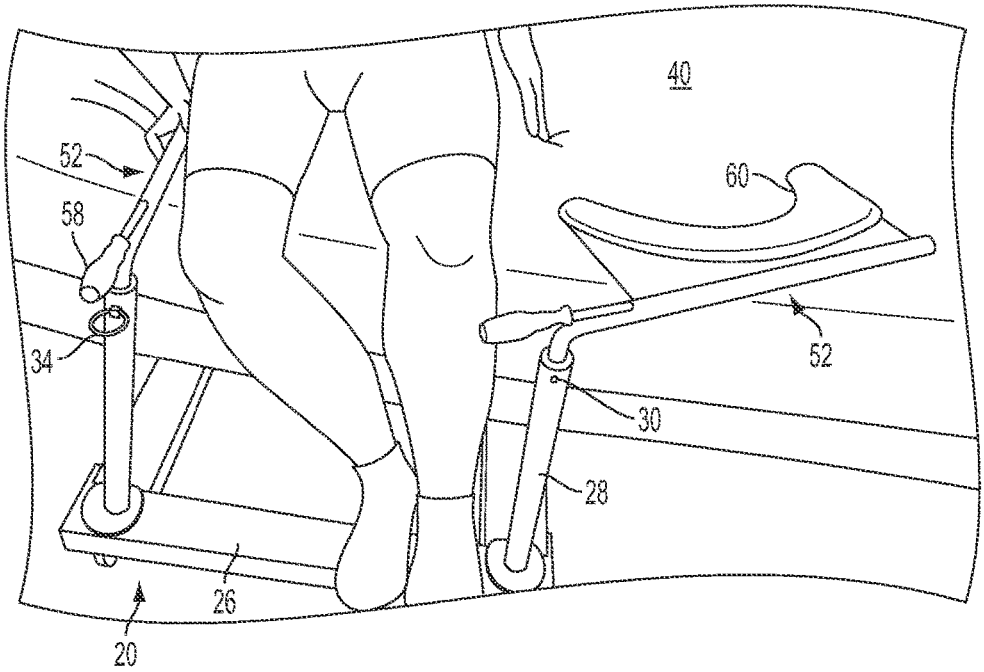

As previously noted, the distance of horizontal arm members 56 from the floor is slightly greater than the distance from the floor to the support surface on which the person sits. As such, seat portions 60 are positioned just above the surface on which the person is originally sitting and minimal effort is required to facilitate insertion of the seat portions under the person, as shown in FIGS. 4C and 4D. More specifically, as shown in FIG. 4C, the person merely tilts slightly to his left so that the left seat portion 60 may be rotated inwardly under the right portion of his backside as it is now raised above mattress 42. Locking pin 34 is then slidably inserted in the corresponding pin apertures so that left pivoting arm assembly 52 is non-rotatably fixed with respect to support frame 20.

Figure 4E:
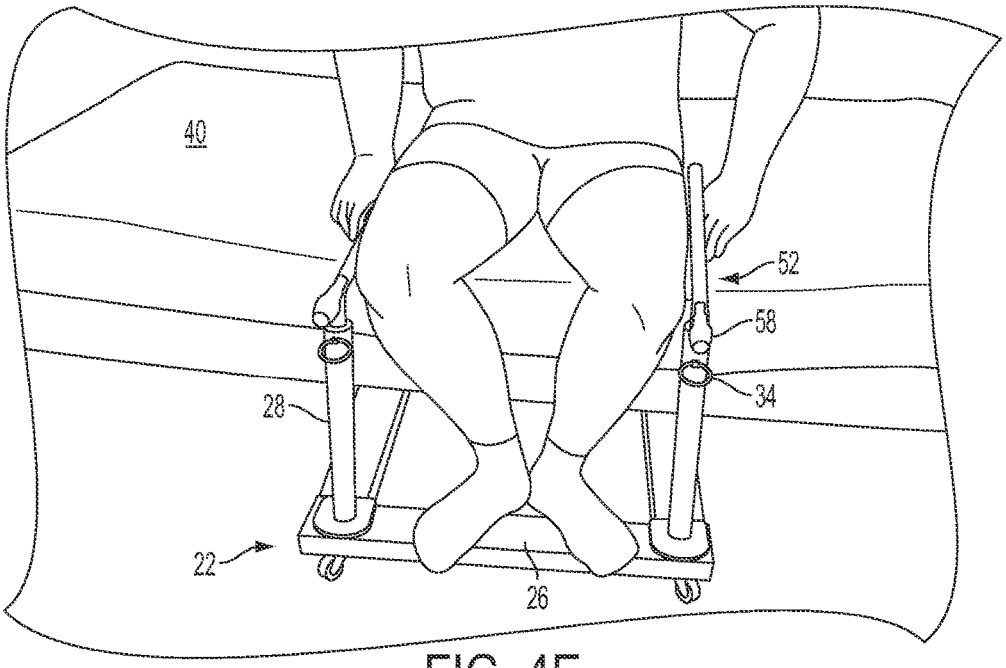

As shown in FIG. 4D, the person then leans slightly to his right, thereby placing weight on seat portion 60 of the left pivoting arm assembly 52. In so doing, the person creates the clearance necessary to rotate seat portion 60 of right pivoting arm assembly 52 underneath the left portion of the person's backside as it is now raised above mattress 42. The full weight of the person is now supported by mobile split-seat assembly 10. As before, locking pin 34 is then inserted in the corresponding pin apertures to non-rotatably fix the right pivoting arm assembly 52 relative to support frame 20, as shown in FIG. 4E.

Figure 4F:
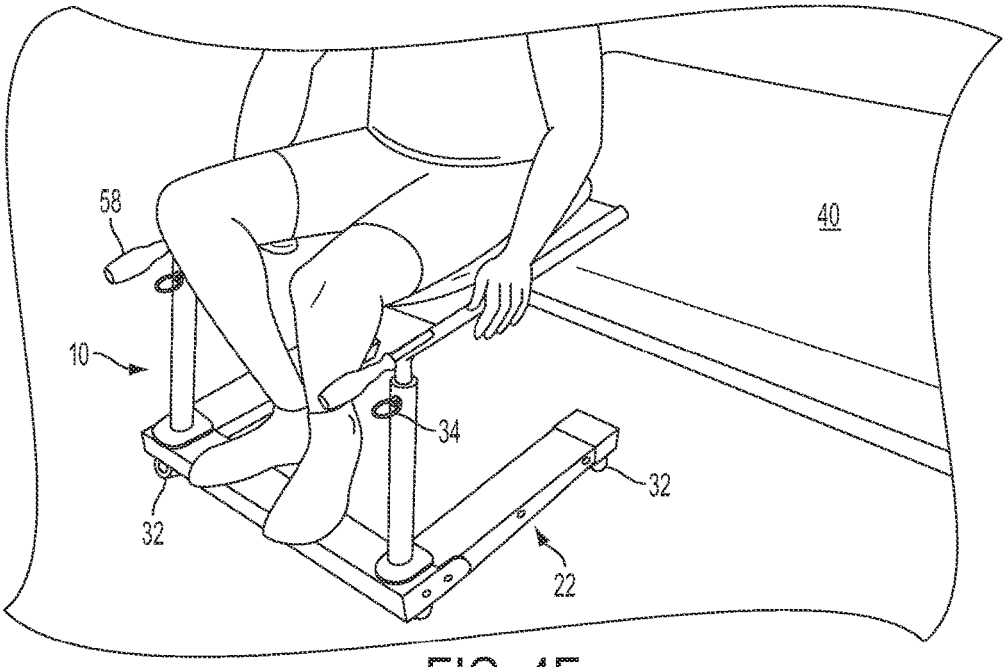
Figure 5:
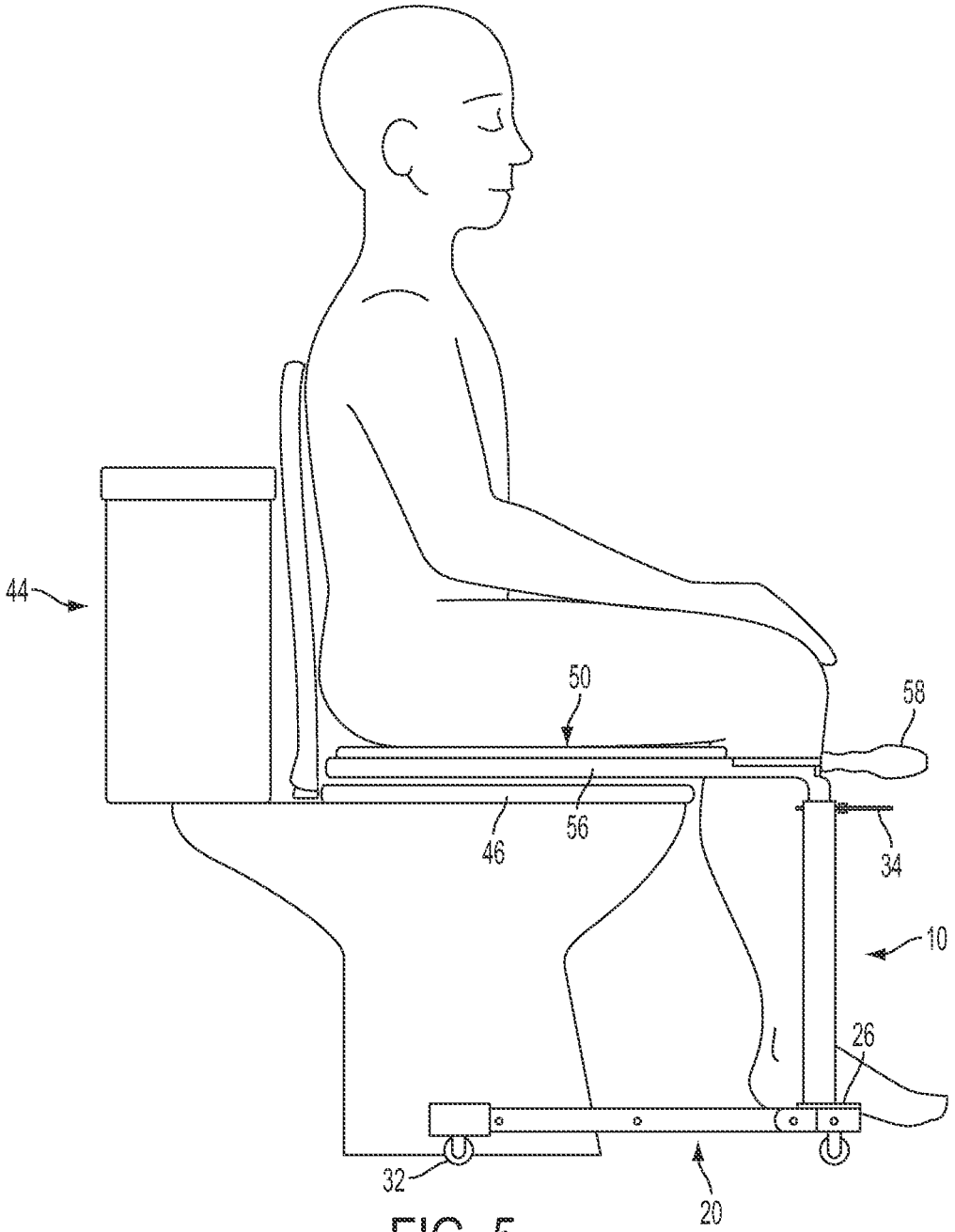
FIG. 5 is a left side view of the mobile split-seat assembly shown in FIG. 1, being used to position a person over a toilet.
Figure 6:
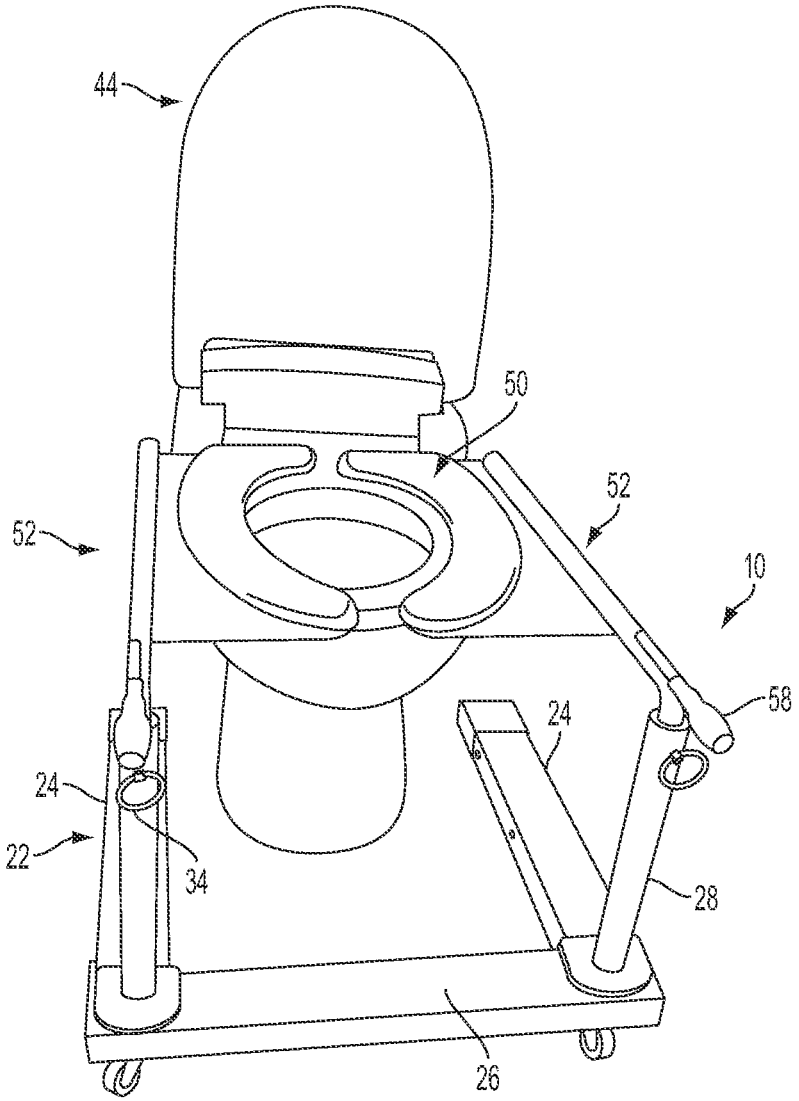
FIG. 6 is a top perspective view of the mobile split-seat assembly shown in FIG. 1, positioned around a toilet.

Referring now to FIG. 4F, once pivoting arm assemblies 52 are non-rotatably fixed to support frame 20, the person being supported can be freely transported on mobile split-seat assembly 10. While transported, the person can rest their feet on front rail 26, which can be provided with a non-skid surface to prevent their feet from sliding off the rail. Preferably, handle portions 58 are utilized by the caretaker to assist in moving mobile split-seat assembly 10 to the desired location, such as a toilet 44, as shown in FIG. 5. Note, the height of horizontal arm members 56 above the floor provide the necessary clearance above an existing toilet seat 46 of toilet 44. Referring additionally to FIG. 6, because base 22 of support frame 20 does not include a back rail, mobile split-seat assembly 10 is readily positionable about toilet 44. To move the person being transported from mobile split-seat assembly 10 back onto mattress 42, the steps discussed above are merely reversed.

Figure 7:
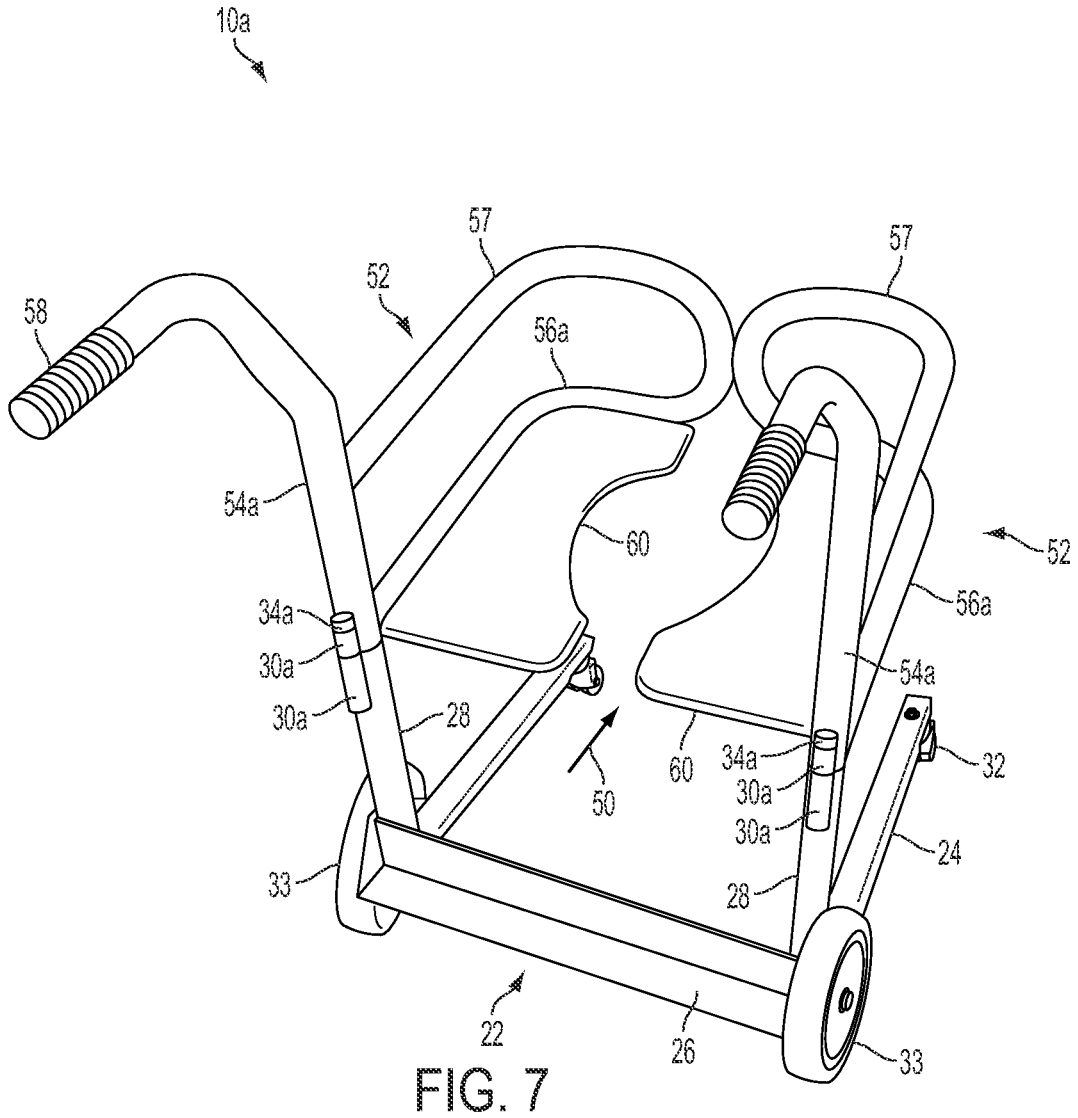
FIG. 7 is a perspective view of a second embodiment of a mobile split-seat assembly in accordance with the present disclosure.
Figure 8:
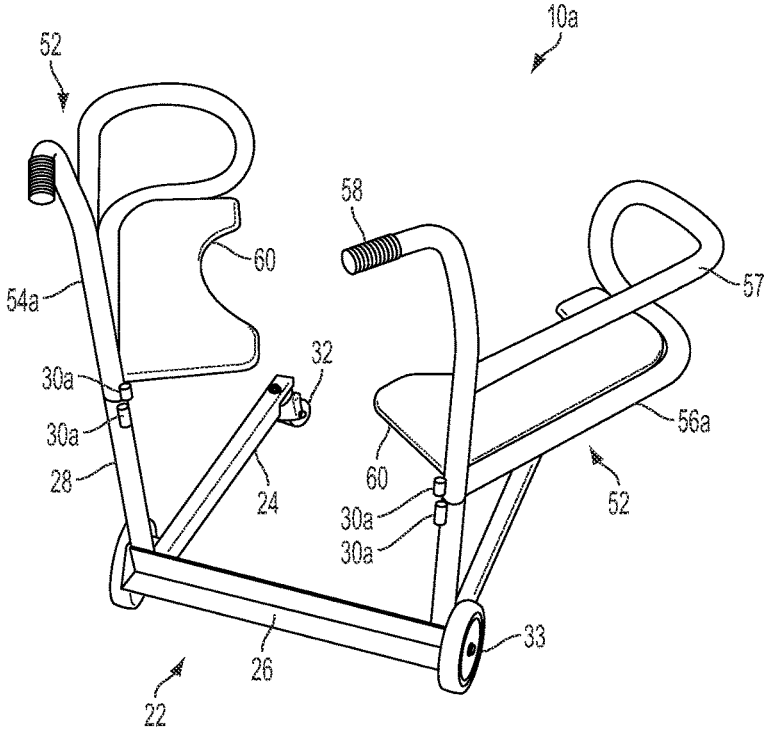
FIG. 8 is a perspective view of the mobile split-seat assembly shown in FIG. 7, with the pivoting arm assemblies in the open position.
Figure 9:
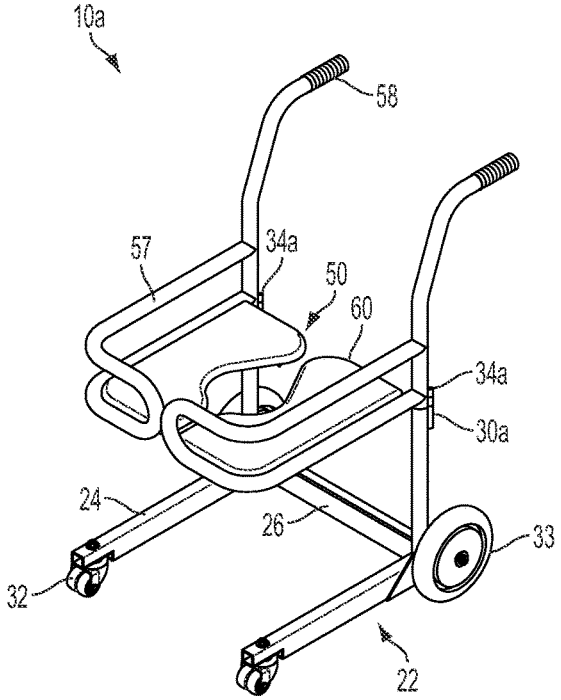
FIG. 9 is a rear perspective view of the mobile split-seat assembly shown in FIG. 7.

Referring now to FIGS. 7 through 9, a second embodiment of a mobile split-seat assembly **10*a* in accordance with the present disclosure is shown. Mobile split-seat assembly 10*a* is similar to the previously discussed embodiment in many aspects, and only the differences are discussed here. For example, horizontal arm member 56*a* of each pivoting arm assembly 52 extends along both the side and back of the corresponding seat portion 60 and is further configured to form a guardrail 57 to help secure the person being transported. As well, vertical arm member 54*a* of each pivoting arm assembly 52 extends upwardly beyond the corresponding horizontal arm member 56*a*, with each handle portion 58 being disposed at the top of the corresponding vertical arm member 54***a*. As such, handle portions 58 are disposed at a height that is readily accessible by a caretaker without having to bend over.

As best seen in FIG. 1, rod-shaped locking pins 34*a* are each received in a pair of corresponding vertical tubes 30*a*, one tube 30*a* being secured to an outer surface of a corresponding vertical support 28 and vertical arm member 56*a*. Vertical tubes 30*a* are configured to be vertically aligned when pivoting arm assemblies 52 are disposed in their innermost positions, as shown in FIG. 7, so that seat portions 60 form the toilet seat. As such, tubes 30*a* are positioned to receive locking pins 34*a* so the pivoting arm assemblies cannot rotate while transporting a person. Note, also, that rather than four casters 32, as in the first embodiment, the present embodiment includes two casters 32 and two wheels 33 of a larger diameter than those of the casters. The larger diameter of wheels 33 facilitate transporting persons over rough surfaces, door ledges, uneven floor transitions, etc.

Figure 10:
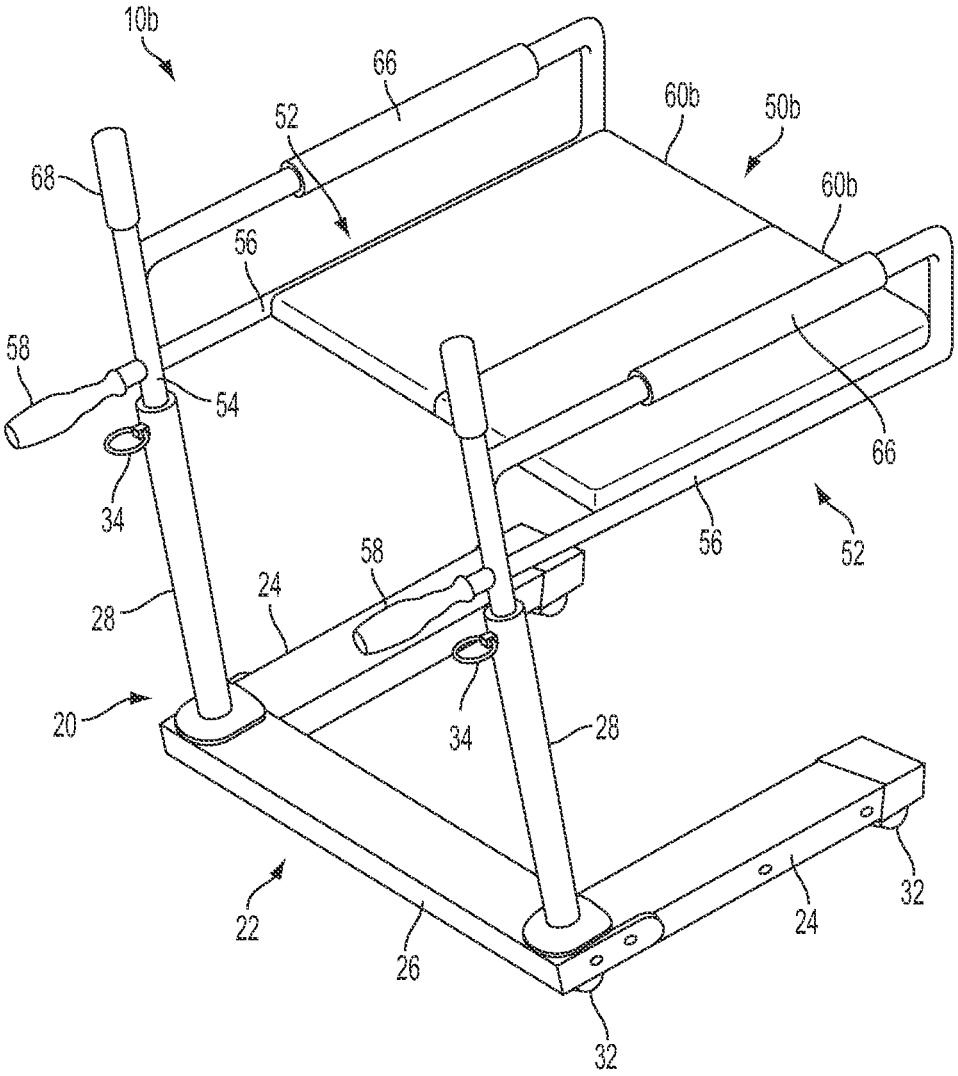
FIG. 10 is a perspective view of a third embodiment of a mobile split-seat assembly in accordance with the present disclosure.

Referring now to FIG. 10, a third embodiment of a mobile split-seat assembly is shown. Mobile split-seat assembly 10*b* differs primarily from the previously discussed first embodiment (FIGS. 1 through 3) in that seat portions 60*b* are not portions of a toilet seat, but rather a padded bench type seat 50*b*. Additionally, padded arm rests 66 and hand grips 68 are provided. Hand grips 68 may be used either by the person being supported on seat 50*b* or by a caretaker to facilitate movement of the supported person on mobile split-seat assembly 10*b*. Other than these differences, mobile split-seat assembly 10*b* is substantially similar to the previously discussed embodiment, with similar reference numerals being used to identify similar elements, and thus, a further discussion is not required.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed is:

1. A mobile split-seat assembly, comprising:

a support frame including a base, a first vertical support extending upwardly from the base and a second vertical support extending upwardly from the base;

a first pivoting arm assembly including a first seat portion, a vertical arm member pivotably received by the first vertical support of the support frame, a horizontal arm member extending outwardly from the vertical arm member, and a handle portion extending outwardly from the vertical arm member opposite the horizontal arm member, wherein the first seat portion is supported by the horizontal arm member and is pivotable in a horizontal plane relative to the support frame; and a second pivoting arm assembly including a second seat portion, the second pivoting arm assembly being supported by the second vertical support so that the second seat portion is pivotable in the horizontal plane relative to the base.

2. The mobile split-seat assembly of claim 1, wherein the first seat portion and the second seat portion form a toilet seat when adjacent each other.

3. The mobile split-seat assembly of claim 1, further comprising a locking pin, wherein the locking pin is slidably received in aligned pin apertures defined by both the first vertical support and the vertical arm member so that the first pivoting arm assembly is non-rotatably fixed to the first vertical support when the locking pin is slidably received by the pin apertures.

4. The mobile split-seat assembly of claim 1, further comprising a one of a plurality of wheels and a plurality of casters disposed on the base of the support frame.

5. The mobile split-seat assembly of claim 1, wherein the base further comprises a pair of parallel side rails and a front rail extending therebetween so that the front rail is perpendicular to both side rails.

6. A mobile split-seat assembly, comprising a support frame including a base with a pair of horizontal side rails and a front rail extending therebetween, and a pair of vertical supports extending upwardly from a front end of the base;

a first pivoting arm assembly including a first toilet seat portion, a vertical arm member pivotably received by a first one of the pair of vertical supports, a horizontal arm member extending outwardly from the vertical arm member, and a handle portion extending outwardly from the vertical arm member opposite the horizontal arm member; and a second pivoting arm assembly including a second toilet seat portion, a vertical arm member pivotably received by a first one of the pair of vertical supports, a horizontal arm member extending outwardly from the vertical arm member, and a handle portion extending outwardly from the vertical arm member opposite the horizontal arm member, wherein the first seat portion and the second seat portion form a full seat when pivoted inwardly toward each other so that the first pivoting arm assembly is parallel to the second pivoting arm assembly.

7. The mobile split-seat assembly of claim 6, wherein the first seat portion and the second seat portion are pivotable in a horizontal plane.

8. The mobile split-seat assembly of claim 6, further comprising:

a first locking pin that is selectively engageable with corresponding pin apertures defined by the first pivoting arm assembly and the first vertical support so that the first pivoting arm assembly is non-rotatably fixed to the support frame; and a second locking pin that is selectively engageable with corresponding pin apertures defined by the second pivoting arm assembly and the second vertical support so that the second pivoting arm assembly is non-rotatably fixed to the support frame.

9. The mobile split-seat assembly of claim 6, further comprising one of a plurality of wheels and a plurality of casters disposed on the base of the support frame.

10. A method of transporting a person with a mobile split-seat assembly including a seat formed by a first seat portion having a handle portion extending horizontally outwardly therefrom and a second seat portion having a handle portion extending horizontally outwardly therefrom, comprising:

positioning the person in a seated position on a support surface;

raising a first portion of the person above the support surface;

grasping the handle portion of the first seat portion and rotating the first seat portion, thereby positioning the first seat portion between the first portion of the person and the support surface so that the first portion of the person is supported by the first seat portion;

raising a second portion of the person above the support surface; and grasping the second handle portion of the second set portion and rotating the second seat portion, thereby positing the second seat portion between the second portion of the person and the support surface so that the person is now supported by the first seat portion and the second seat portion.

11. The method of claim 10, wherein:

positioning the first seat portion further comprises rotating the first seat portion in a horizontal plane; and positioning the second seat portion further comprises rotating the second seat portion in the horizontal plane.

12. The method of claim 11, further comprising rolling the seat away from the support surface.

13. The method of claim 11, wherein:

raising a first portion of the person further comprises tilting the person to a first side opposite the first portion, and raising a second portion of the person further comprises tilting the person to a second side opposite the second portion.

14. The method of claim 13, wherein when the first portion of the person is raised above the support surface, the second portion of the person remains supported by the support surface.

15. A mobile split-seat assembly, comprising:

a support frame including a base, a first vertical support extending upwardly from the base and a second vertical support extending upwardly from the base;

a first pivoting arm assembly including a first seat portion, a vertical arm member pivotably received by the first vertical support of the support frame, a horizontal arm member extending outwardly from the vertical arm member, and a handle portion extending outwardly from the vertical arm member opposite the horizontal arm member, wherein the first seat portion is supported by the horizontal arm member and is pivotable in a horizontal plane relative to the support frame;

a second pivoting arm assembly including a second seat portion, the second pivoting arm assembly being supported by the second vertical support so that the second seat portion is pivotable in the horizontal plane relative to the base; and a locking pin, wherein the locking pin is slidably received in aligned pin apertures defined by both the first vertical support and the vertical arm member so that the first pivoting arm assembly is non-rotatably fixed to the first vertical support when the locking pin is slidably received by the pin aperture.

16. The mobile split-seat assembly of claim 15, wherein the first seat portion and the second seat portion form a toilet seat when adjacent each other.

17. The mobile split-seat assembly of claim 15, further comprising a one of a plurality of wheels and a plurality of casters disposed on the base of the support frame.

18. A mobile split-seat assembly, comprising:

a support frame including a base with a pair of horizontal side rails and a front rail extending therebetween, and a pair of vertical supports extending upwardly from a front end of the base;

a first pivoting arm assembly including a first seat portion, the first pivoting arm assembly being pivotably supported by a first one of the pair of vertical supports;

a second pivoting arm assembly including a second seat portion, the second pivoting arm assembly being pivotably supported by a second one of the pair of vertical supports;

a first locking pin that is selectively engageable with corresponding pin apertures defined by the first pivoting arm assembly and the first vertical support so that the first pivoting arm assembly is non-rotatably fixed to the support frame; and a second locking pin that is selectively engageable with corresponding pin apertures defined by the second pivoting arm assembly and the second vertical support so that the second pivoting arm assembly is non-rotatably fixed to the support frame, wherein the first seat portion and the second seat portion form a full seat when pivoted inwardly toward each other so that the first pivoting arm assembly is parallel to the second pivoting arm assembly.

19. The mobile split-seat assembly of claim 18, wherein the full seat formed by the fist seat portion and second seat portion is a toilet seat.

20. The mobile split-seat assembly of claim 18, further comprising one of a plurality of wheels and a plurality of casters disposed on the base of the support frame.

21. A mobile split-seat assembly for transporting a person, comprising:

a support frame including a base with a front rail and a pair of parallel side rails extending rearwardly therefrom, a first vertical support and a second vertical support extending upwardly from the front rail of the base so that the front rail and the first and the second vertical supports define a U-shaped support frame portion with an open top and a void defined therebetween;

a first pivoting arm assembly including a first seat portion, the first pivoting arm assembly being supported by the first vertical support so that the first seat portion is pivotable in a horizontal plane relative to the support frame; and a second pivoting arm assembly including a second seat portion, the second pivoting arm assembly being supported by the second vertical support so that the second seat portion is pivotable in the horizontal plane relative to the base, wherein the open top and the void defined by the U-shaped support frame portion allow a portion of the person to pass between the first and the second vertical supports.

22. The mobile split-seat assembly of claim 21, wherein the first seat portion and the second seat portion form a toilet seat when adjacent each other.

23. The mobile split-seat assembly of claim 21, further comprising:

a first locking pin that is selectively engageable with corresponding pin apertures defined by the first pivoting arm assembly and the first vertical support so that the first pivoting arm assembly is non-rotatably fixed to the support frame; and a second locking pin that is selectively engageable with corresponding pin apertures defined by the second pivoting arm assembly and the second vertical support so that the second pivoting arm assembly is non-rotatably fixed to the support frame.

* * * * *